US006767263B1

(12) United States Patent
Tornblad et al.

(10) Patent No.: US 6,767,263 B1
(45) Date of Patent: Jul. 27, 2004

(54) PROPULSION SYSTEM FOR A SHIP

(75) Inventors: Jens Tornblad, Kristinehamn (SE); Christer Häger, Kristinehamn (SE); Sven-Gunnar Karlsson, Kristinehamn (SE); Gunnar Styrud, Kristinehamn (SE)

(73) Assignee: Rolls-Royce Aktiebolag, Kristinehamn (SE)

( * ) Notice: Subject to any disclaimer, the term of this patent is extended or adjusted under 35 U.S.C. 154(b) by 0 days.

(21) Appl. No.: 10/297,132

(22) PCT Filed: Jun. 7, 2001

(86) PCT No.: PCT/SE01/01291

§ 371 (c)(1),
(2), (4) Date: Dec. 3, 2002

(87) PCT Pub. No.: WO01/94195

PCT Pub. Date: Dec. 13, 2001

(51) Int. Cl.[7] ..... B63H 23/34; B63H 11/00
(52) U.S. Cl. ..... 440/83; 440/38
(58) Field of Search ..... 60/221; 440/38, 440/40, 41, 42, 43, 47, 83

(56) References Cited

U.S. PATENT DOCUMENTS

| | | | | |
|---|---|---|---|---|
| 4,664,644 A | * | 5/1987 | Kumata et al. | 464/180 |
| 4,863,416 A | * | 9/1989 | Gupta | 464/181 |
| 5,045,002 A | | 9/1991 | Torneman et al. | 440/38 |
| 5,720,635 A | * | 2/1998 | Roos | 440/38 |
| 6,053,783 A | | 4/2000 | Brunn | 440/78 |
| 6,057,787 A | * | 5/2000 | Kell et al. | 340/984 |
| 2003/0153217 A1 | * | 8/2003 | Tornblad et al. | 440/49 |

FOREIGN PATENT DOCUMENTS

| | | |
|---|---|---|
| NO | 124674 | 5/1972 |
| SE | 504 604 | 3/1997 |
| WO | WO 97/26183 | 7/1997 |

OTHER PUBLICATIONS

Copy of International Search Report.

* cited by examiner

*Primary Examiner*—Sherman Basinger
(74) *Attorney, Agent, or Firm*—Michael D. Bednarek; Shaw Pittman LLP

(57) ABSTRACT

A propulsion system for ships having an impeller (13, 14), a stator shell (1), and an impeller housing (3) for achieving a water jet, a shaft (11, 12) for the propulsion of the impeller (13), and a bearing arrangement for the shaft (11, 12) in the stator shell (1), and preferably a sealing (15) of the shaft (11, 12) in the impeller housing (3), wherein the shaft (11, 12) consists of a light weight shaft, which has considerably lower bending rigidity than a homogenous, conventional steel shaft, and the driving force is transmitted via at least one non-flexible coupling (11B, 12A) and via the bearing arrangement which is rigid as to bending and handles the axial load, to the stator shell (1), such that a high power density is achieved.

17 Claims, 1 Drawing Sheet

PROPULSION SYSTEM FOR A SHIP

TECHNICAL FIELD

The present invention relates to a propulsion system for ships, which propulsion system comprises one or several impellers for generating a force that drives the ship forward. The impeller, being rotatable in an impeller house by means of the driving shaft, is provided with blades of the propeller type, which produce the jet stream backwards.

PRIOR ART AND PROBLEMS

The propulsion of ships, preferably fast moving ships, both military and civilian ones, through water jet arrangement, comprising impellers are generally known. The housing surrounding the rotating impeller provided with blades is fixedly mounted to the rear portion of the hull. The impeller is typically driven by a steel shaft extending towards the stem by suitable arrangements that in turn are driven by one or several engines within the hull. A tube-like water inlet, which slopes somewhat downwards in the moving direction, is provided in front of the impeller housing in order to supply a large amount of water. The driving shaft thus runs through said tubular water inlet. The ship is controlled by means of steering devices downstream the impeller housing (or housings), which may direct the jet stream in different directions. The jet stream may also be directed forwards to give a decelerating effect.

As the driving shaft of the impeller extends through the water inlet, the incoming flow of water to the impeller is disturbed to some extent, which implies that an unevenly distributed load on the blades of the impeller is created. Said uneven load implies that a bending moment is transferred to the impeller inwards towards the attachment point of the impeller. Because of these varying forces influencing the impeller and its attachment point, very high requirements are put on the arrangement of the bearings and scalings. It is known from SE 424 845 (corresponding to U.S. Pat. No. 4,474,561) to solve said problem by arranging the impeller fixedly mounted to the shaft and to arrange a bearing arrangement allowing a certain angle deviation. However, said solution requires a design with a bending rigid driving shaft (in order not to risk too great angle deviations), which design thus is very heavy. It is not unusual that only the weight of the driving shaft in such a design amounts to about 10% of the total weight of the water jet device (including the weight of the pump unit including stator part with guide vanes, thrust and journal bearing arrangement, impeller and impeller housing and the steering and reversing gear). Another known solution is shown in SE 457 165 (corresponding to U.S. Pat. No. 5,045,002) and SE 504 604, wherein a bearing arrangement is used which cannot handle angle deviations and wherein a flexible coupling between the driving shaft and the impeller is used instead, the coupling being intended to handle the angle deviations. Also said last mentioned solution leads to a heavy design, especially since the coupling as such implies an additional weight. Further, it implies a considerable drawback as the coupling is provided at a critical position as to flow, which implies that it is difficult to obtain optimal flow conditions.

The design described in SE 424 845 has satisfactory properties per se, but as mentioned it is heavy because of the rigid, conventional impeller shaft. In certain applications, especially military ones, it is of great importance to reduce the weight and at the same time to obtain optimal flow conditions with devices loaded to a high degree, which implies that conventional water jet design may not be used. Another reason to it not being desirable to use a coupling in connection with such applications is that the coupling implies a power limitation. It is realized that a detail that limits the power transmission is not desirable in such applications, as, especially with such applications, it many times is desirable to be able to transfer a lot of power, often in the interval of 3–30 MW. For long it has been a desire to reduce the weight by replacing the conventional impeller shaft by a lighter shaft and at the same time to eliminate the need of a flexible coupling. Hitherto, that has not been put into practice by anyone.

Indeed it is mentioned in SE 504 604 that the flexible coupling may be eliminated. However, it is not described how this may be achieved. Moreover, there is no indication how the high stresses from a bending rigid shaft might be handled. The design according to SE 504 604 instead shows the use of a flexible coupling and is directed to an embodiment, which makes it possible to dismount the bearing unit backwards. This implies i.a. that the guide vanes, which transmit the force from the impeller to the stator shell, must have a very limited extension. This implies in turn that the possibility of achieving an optimal solution as to weight, flow and strength is limited. Above all, it implies the great drawback that the possibility to transmit very large powers is in principle not practically achievable. Thus, the design does not offer the possibility to good power density (with power density is meant the maximal power output divided with the weight of the water jet unit, comprising the weight of the pump unit including stator part with guide vanes, thrust and journal bearing arrangement, impeller and impeller housing and the steering and reversing gear), i.e. the weight will be comparatively high in relation to the maximal power which may be transmitted. With this design it is probably difficult to achieve a power density above 1.0 kW/kg for a water jet having an inlet diameter above 1 m, which is an undesired and serious limitation. As is evident for the skilled man the power density for the same kind of design does decrease with increased size.

THE SOLUTION

An objective of the invention is to find an optimal solution of the above described complex of problems. Said objective is achieved by a propulsion system for ships comprising an impeller, a stator shell, and an impeller housing for achieving a water jet, a shaft for the propulsion of the impeller, and a bearing arrangement for the shaft in the stator shell, and preferably a sealing of the shaft in the impeller housing, wherein the shaft consists of a light weight shaft, which has considerably lower bending rigidity than a conventional steel shaft, and the driving force is transmitted via at least one non-flexible coupling and via said bearing arrangement which is rigid as to bending and handles the axial load, to the stator shell, such that a high power density is achieved.

Because of the use of a light weight shaft, which becomes comparatively weak as to bending, conditions are created to use a bearing arrangement which is rigid with reference to bending moments and which handles an axial load and at the same time for using non-flexible couplings (e.g. attachment by screws) between the impeller and the end portion of the driving shaft. At the same time, the comparatively weak driving shaft meet the objective to achieve a weight reduction. Further, it makes a cost saving possible with reference to the shaft as the choice of material is optimised in this respect. The shaft may thus be made comparatively slender, and because of the preferred attachment directly against the impeller, optimal conditions are obtained to create as good flow paths as possible, which in turn may imply reduced bending forces influencing the bearing arrangement of the impeller.

According to a preferred embodiment of such a driving system, the driving shaft consists at least mainly of a composite material. Above all, a composite shaft has the great advantage that very low weights may be obtained. A weight reduction of up to 70% as compared to a conventional steel shaft is possible. Further, the advantage is obtained that a composite shaft is exceptionally bendable, which is an advantage with reference to the bearing arrangement. A low bending rigidity is also desirable and a composite shaft may give a reduction of the bending rigidity of about 80% as compared to a conventional, homogenous steel shaft.

According to another aspect, the composite shaft comprises a tubular frame of a first fibrous material, preferably carbon fibre, surrounded by a layer of a second fibrous material, preferably glass fibre, and preferably an outermost erosion protection of an erosion resistant material, preferably polyurethane. As the driving shaft partly lies in the water flow, which may contain some hard and/or abrasive objects, and as a composite shaft, e.g. of carbon fibre, is sensitive to impacts, a preferred embodiment is such a shaft with an impact resistant layer and a protective layer, respectively, which minimises the risk for breakdowns.

According to an additional aspect of the invention, at least some portion of said impeller housing is made of a light weight material, preferably comprising carbon fibre, wherein preferably said portion of the impeller housing is coated with a protective surface, preferably polyurethane. It is the solution according to the invention, which creates the conditions for this additional weight reduction. The reason is that the very bending rigid bearing mounting of the impeller, which in practice is free from play, implies that extremely a good positioning of the impeller blades is obtained with reference to the housing, so that the risk for contact between the ends of the blades and the impeller housing is in principle eliminated. Thus, the solution according to the invention implies that one with larger safety gets the possibility to reduce the weight of the impeller housing, i.e. one may use "weaker" and/or thinner material for the impeller housing.

According to further potential aspects:

said bearing arrangement consists of a spherical axial bearing in combination with a conical roller bearing;

the bearings in the impeller housing are lubricated with oil or grease and sealed to the environment by an axially resilient sealing provided in front of the front bearing;

at least one portion of said impeller housing is made of light weight material, preferably comprising carbon fibre;

the inlet diameter D of said impeller housing is between 0.5–2 m and that the power density is at least 0.5+(2–D) kW/kg, D is between 0.5–1.3 m and that said power density is 0.7+(2–D) kW/kg, said light weight shaft is made of metal, preferably titanium and/or a hollow steel shaft;

there is no flexible coupling for the transmission of power from the shaft to the impeller, the inlet diameter D of said impeller housing is above 2 m and the nominal maximum design power is at least 15 MW.

Thanks to the invention, it is possible, as compared to conventional systems, to build a substantially much lighter driving system for a water-jet driven ship and which at the same time provides for a high reliability in operation possible.

DESCRIPTION OF DRAWINGS

The invention will be described more in detail with reference to the accompanying drawing which is a vertical, axial cross section of an impeller and an impeller housing according to a preferred embodiment.

DETAILED DESCRIPTION OF THE INVENTION

Figure 1:
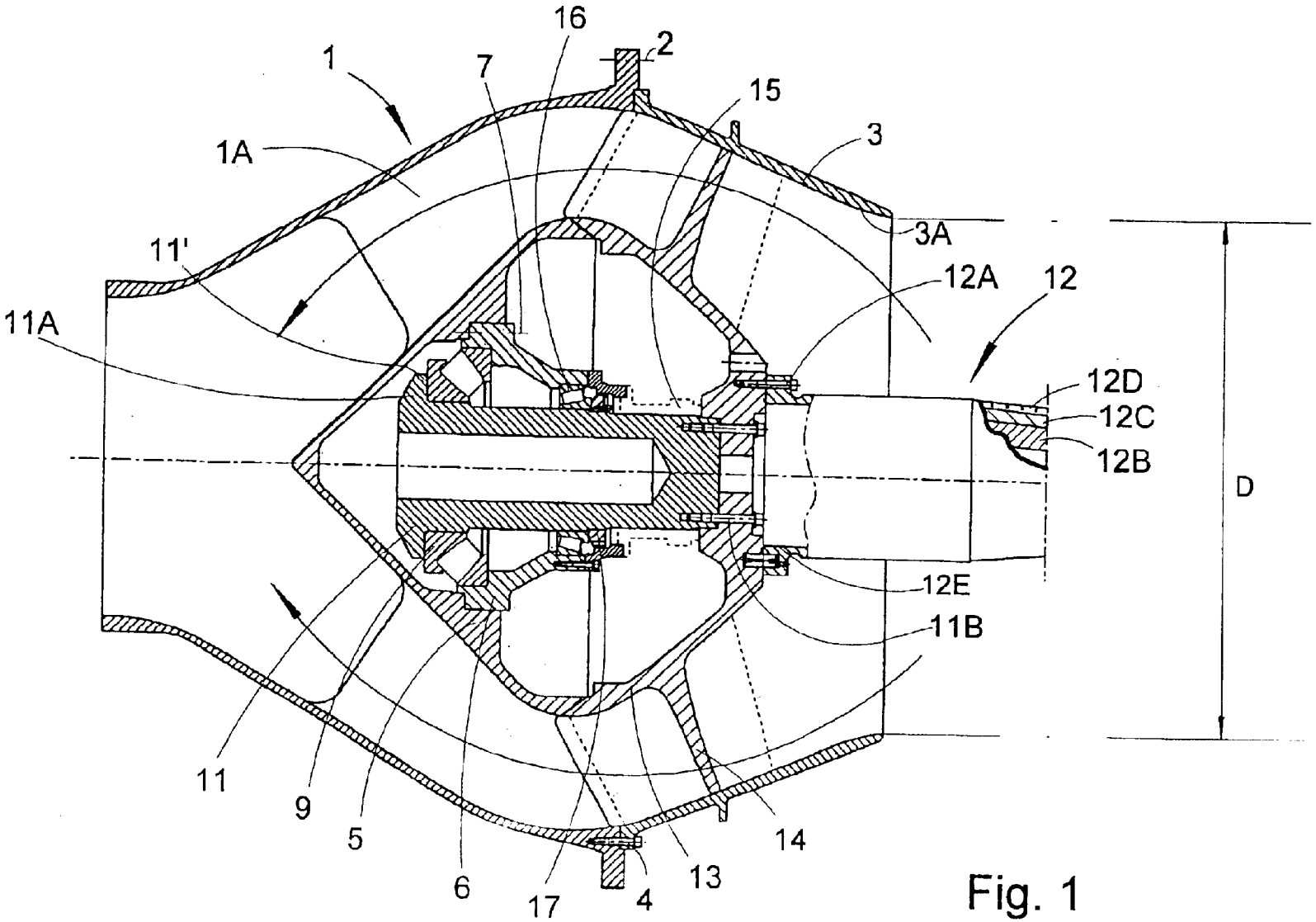

FIG. 1 shows an impeller device in a vertical section according to the invention. A stator shell 1 is fixedly mounted to the rear portion of the hull by bolts 2 or the like. An impeller housing 3, in the form of a conical front portion, is mounted to the stator portion 1 by screws 4 or the like. Said front portion of the impeller housing 3 is aligned to a tubular water inlet extending forwards, which is known per se (not shown). The shaft journal 11 is in relation to turning and bending fixedly connected to the shaft 12 by means of a first coupling 11B via the base portion 13 of the impeller.

Rearwardly, adjacent the impeller base 13, there is arranged a cone shaped housing 5, which is fixedly secured within the stator shell with its tip directed backwards, by means of non-rotating guide vanes 1A. There is a bearing seat 6 within said housing 5, which seat is mounted by screws 7 approximately in the middle of the housing and which seat is intended to support a bearing arrangement 9, 16 for a shaft journal to the driving shaft 12. For allowing water to be evacuated from the inner of the housing 5 there is a set of drainage holes 13A arranged comparatively near the centre (where the pressure is relatively low) of the impeller base 13.

The rotating impeller base 13 is via a second non-turnable and bending rigid coupling 12A, suitably a screw connection, fixedly mounted about the shaft journal 11. Thus, said impeller base 13 rotates together with the shaft 12, and impeller blades 14 are provided on said impeller base 13. Said impeller blades 14 create the water jet flow which is directed backwards and which is shown by arrows. Said backwards directed water jet flow causes via the impeller 13, 14 a forwards directed recoil force in the shaft journal 11, which force is transmitted via the axial roller bearing 9 to the bearing seat 6, the housing 5, and to the stator portion 1 by the impeller housing which is fixedly connected to the hull, which thus gets a forwards directed propulsion force.

The shaft 12 is a lightweight shaft, which is suitably made of a composite material, with an attachment means 12E of metal (e.g. steel) at its end. The core 12B as such of the shaft is suitably made of carbon fibre, but as the shaft partly is located within the water flow, which may contain different hard objects, carbon fibre is not always a suitable surface material for such a shaft. Arranging a protective sleeve 12C of glass fibre about the shaft has solved this problem. To give the shaft good properties to resist erosion/abrasive objects, it is preferably also provided with polyurethane as an outer surface layer 12D. A shaft of composite material of this kind is not only light but is also less rigid than conventional shafts. Above all it has a lower bending stiffness than conventional shafts. The higher bending stiffness of a conventional shaft puts heavy requirements on the bearing system. An axial roller bearing 9, for example a spherical axial bearing 9, has been provided at the rear end of the shaft journal 11. As the locking ring 17 clamps the bearings 9 and 16 in this way, a rigid bearing will be obtained which may handle the bending forces created by the non-rigid shaft and by the flow, while the axial propulsion force caused by the impeller blades 14 comes through the rear axial bearing 9 (the axial roller bearing 9). Suitably the bearings are clamped so much that a minimum load occurs on the bearings, which usually implies that an axial play of max 0.05 mm, often 0–0.02 mm, is obtained, and thereby a rigid bearing is achieved. For certain applications the bearings are suitably biased, so that the axial play always is 0 mm.

In the drawing, a spherical axial bearing 9 is shown, but it is also possible to use another kind of bearing, for instance sliding bearings. The bearings 9, 16 in the impeller housing 3 may be lubricated with oil or grease and sealed to the environment by an axially resilient sealing 15 provided in front of the front bearing.

According to a further potential aspect, the light weight shaft 12 is made of metal, preferably titanium and/or a hollow steel shaft.

The space around the roller bodies of the bearings 9 and 16 is normally filled with oil, which is normally supplied through conduits (not shown), through a guide vane 1A, and a bearing seat 6. Therefore, said space must be sealed to water surrounding the shaft journal and the bearing seats.

By means of the present invention it has been possible to reduce the weight drastically by in the first place replacing the conventional impeller shaft by a composite shaft, which may be done because of the bearing arrangement 9, 16 in combination with the fixed connections at the end of the shaft.

Another weight reducing step being possible because of the arrangement of the bearing and the shaft according to the invention is that also the inlet wall 3 in the impeller housing is made of a composite material, which is coated with polyurethane 3A to obtain an impact resistant and abrasion resistant surface. Because of the embodiment according to the invention a structural principle is obtained, which provides for a desirably high power density. Thanks to the principles of the bearing arrangement and the power transmission a power density of 1 kW/kg is easily obtained for water jets having an inlet diameter below 1.3 meters, which implies essential advantages with respect to many aspects, i.a. operating economy and maneuverability. As is evident for the skilled man the power density for the same kind of design does decrease with increased size. Accordingly it is more difficult to achieve a high power density for large water jets. It has been found that the new design does provide for power density that is at least 0.5+(2−D) kW/kg, where D is the inlet diameter of the impeller housing and D is between 0.5–2 m. In the interval where D is between 0.5–1.3 m the power density is even better, e.g. 0.7+(2−D) kW/kg. If all aspects according to the invention are combined a power density of about 2 kW/kg, may be obtained for a water jet with an inlet diameter D of 1 meter. Also for very large water jets, having an inlet diameter D above 2 m, the design according to the invention does improve the power density, but since for time being water jets in this range are very rare there does not exist any relevant figures for comparison in relation to power density within this range, where the nominal maximum design power normally is well above 10 MW.

The invention is not limited to the embodiments shown above but may be varied in different ways within the scope of the patent claims. For instance, it is realised that other materials having properties corresponding to carbon fibre and glass fibre, respectively, may be used in the shaft of composite material and that many different combinations of such materials may be used depending on the specific requirements. Further, it is realised that other erosion protecting coatings than polyurethane may be used, which can meet approximately the same requirements. It should be understood that other bearing arrangements than oil lubricated ones might be used. Thus, a water lubricated bearing may advantageously be used for certain applications to handle the axial force, wherein also the requirements on sealings are eliminated/reduced to a certain extent. It should also be understood, that the properties of the driving shaft may be adapted to given conditions in many different ways, above all concerning the mounting position of the different shaft bearings in front of the impeller and the water inlet, which, except influencing the natural frequency of the shaft also influences the forces transferred to the bearing arrangement, wherein the shaft bearing is preferably placed as far ahead of the bearing arrangement of the impeller housing as possible, as a definite deviation in the radial direction then results in a comparatively small angle deviation.

Finally, the man skilled in the art realizes that the joints need not be detachable. It may be conceived that the shaft 12 and the shaft journal 11 are integrated. Further, the impeller may be shrunk on the shaft and/or shaft journal, and that other similar modifications falls within the scope of the general knowledge of the man skilled in the art. Moreover, it is evident that the new shaft arrangement according to the invention sometimes also may be used in conjunction with low power density water jet units.

What is claimed is:

1. A propulsion system for ships, comprising:

an impeller, a stator shell, and an impeller housing for achieving a water jet, a shaft for the propulsion of the impeller, and a bearing arrangement for the shaft in the stator shell, wherein the shaft is a light weight shaft, which has considerably lower bending rigidity than a homogenous, conventional steel shaft, and the driving force between the impeller and an end portion of the shaft is transmitted via a non-flexible couplings and via said bearing arrangement which is rigid as to bending and handles the axial load, to the stator shell.

2. A propulsion system according to claim 1, characterised in that said light weight shaft to an essential extent comprises a composite material.

3. A propulsion system according to claim 2, characterised in that the composite shaft comprises a tubular frame of a first fibrous material surrounded by a layer of a second fibrous material.

4. A propulsion system according to claim 3, characterised in that in first fibrous material is a carbon fibre material and in that the second fibrous material is a glass fibre material.

5. A propulsion system according to claim 4, characterised in that the composite shaft has an outermost erosion protection of an erosion resistant material.

6. A propulsion system according to claim 5, characterised in that the erosion resistant material is polyurethane.

7. A propulsion system according to claim 1, characterised in that said bearing arrangement consists of a spherical axial bearing in combination with a conical roller bearing.

8. A propulsion system according to claim 7, characterised in that the bearings in the impeller housing are lubricated by oil or grease and sealed against the environment by an axial, resilient sealing provided in front of the bearing.

9. A propulsion system according to claim 1, characterised in that the inlet diameter D of said impeller housing (3) is between 0.5–2 m and that the power density is at least 0.5+(2−D) kW/kg.

10. A propulsion system according to claim 9, characterised in that D is between 0.5–1.3 m and that said power density is 0.7+(2−D) kW/kg.

11. A propulsion system according to claim 1, characterised in that at least one portion of said impeller housing is made of light weight material.

12. A propulsion system according to claim 11, characterised in that said portion of the impeller housing is coated with a protective surface.

13. A propulsion system according to claim 12, charasterised in that said portion of the impeller housing is coated with polyurethane.

14. A propulsion system according to claim 1, characterised in that said light weight shaft is made of metal.

15. A propulsion system according to claim 14, characterised in that the light weight shaft is made of titanium.

16. A propulsion system according to claim 14, charasterised in that the light weight shaft is a hollow steel shaft.

17. A propulsion system according to claim 1, charasterised in that at least one portion of said impeller housing is made of a light weight material that comprises carbon fibre.

* * * * *